US006472821B1

(12) United States Patent
Hirokado et al.

(10) Patent No.: US 6,472,821 B1
(45) Date of Patent: Oct. 29, 2002

(54) AC PLANE DISCHARGE TYPE PLASMA DISPLAY PANEL

(75) Inventors: Yoshinobu Hirokado; Shinichiro Nagano, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 167 days.

(21) Appl. No.: 09/605,476

(22) Filed: Jun. 28, 2000

Related U.S. Application Data

(63) Continuation of application No. PCT/JP98/04905, filed on Oct. 29, 1998.

(51) Int. Cl.[7] ..... H01J 17/49
(52) U.S. Cl. ..... 313/586; 313/495; 313/582
(58) Field of Search ..... 313/491, 493, 313/582, 584, 585, 586, 495

(56) References Cited

U.S. PATENT DOCUMENTS 5,703,437 A * 12/1997 Komaki ..... 313/587
6,008,580 A * 12/1999 Nakamura et al. ..... 313/568
6,232,717 B1 * 5/2001 Oida et al. ..... 313/586
6,348,762 B1 * 2/2002 Nunomura et al. ..... 313/582

FOREIGN PATENT DOCUMENTS

| | | |
|---|---|---|
| JP | 51134564 | 11/1976 |
| JP | A-5303916 | 11/1993 |
| JP | A-7130307 | 5/1995 |
| JP | A-8222128 | 8/1996 |
| JP | A-9326208 | 12/1997 |
| JP | A-10289660 | 10/1998 |
| JP | A-10302648 | 11/1998 |

* cited by examiner

*Primary Examiner*—Robert H. Kim
*Assistant Examiner*—Jurie Yun

(57) ABSTRACT

An AC plane discharge type plasma display panel comprises the first substrate section comprising a glass substrate containing sodium oxide, an insulating film being a $SiO_2$ film having about 100 nm in thickness and formed by dry film formation method on the surface of the glass substrate, plural pairs of discharge sustain electrodes each comprising a transparent electrode and a bus electrode and formed on the insulating film, a dielectric layer formed on the insulating film in such a manner as to cover the plural pairs of discharge electrodes, and a cathode film formed on the dielectric layer.

4 Claims, 9 Drawing Sheets

$SiO_2$ BY CVD UNDER NORMAL PRESSURE

| $SiO_2$ THICKNESS (nm) | OCCURRENCE OF IRREGULAR FRINGES (%) |
|---|---|
| 50 | 38 |
| 100 | 10 |
| 200 | 1 |
| 300 | 0 |

$SiO_2$ BY CVD

| $SiO_2$ THICKNESS (nm) | ELECTROSTATIC CAPACITY RATIO |
|---|---|
| 50 | 1.20 |
| 100 | 1.10 |
| 200 | 1.04 |
| 300 | 1.03 |

TEST TIME AND ELECTROSTATIC CAPACITY RATIO OF $SiO_2$ FILM BY CVD UNDER NORMAL PRESSURE

| TEST TIME | 50nm THICK | 100nm THICK | 200nm THICK |
|---|---|---|---|
| 0 | 1 | 1 | 1 |
| 2 | 1.09 | 1.04 | 1.02 |
| 4 | 1.14 | 1.06 | 1.02 |
| 6 | 1.18 | 1.07 | 1.03 |
| 8 | 1.19 | 1.09 | 1.03 |
| 10 | 1.20 | 1.10 | 1.04 |

$SiO_2$ BY SOL-GEL METHOD

| $SiO_2$ THICKNESS (nm) | OCCURRENCE PERCENTAGE OF IRREGULAR FRINGES (%) |
|---|---|
| 100 | 40 |
| 200 | 12 |

$SiO_2$ BY SOL-GEL METHOD

| $SiO_2$ THICKNESS (nm) | ELECTROSTATIC CAPACITY RATIO |
|---|---|
| 100 | 1.20 |
| 200 | 1.09 |

TEST TIME AND ELECTROSTATIC CAPACITY RATIO OF $SiO_2$ FILM BY SOL-GEL METHOD

| TEST TIME | 100nm THICKNESS | 200nm THICKNESS |
|---|---|---|
| 0 | 1 | 1 |
| 2 | 1.08 | 1.03 |
| 4 | 1.13 | 1.06 |
| 6 | 1.17 | 1.07 |
| 8 | 1.19 | 1.08 |
| 10 | 1.20 | 1.09 |

AC PLANE DISCHARGE TYPE PLASMA DISPLAY PANEL

This Application is a continuation of International Application NO. PCT/JP98/04905,whose international filing date is Oct. 29, 1998, the disclosures of which Application are incorporated by reference herein.

BACKGROUND OF THE INVENTION

1. Field of the Invention

The present invention relates to an AC plane discharge type plasma display panel used as a display device for a display apparatus such as monitor and, more particularly, to an improvement in reliability and display quality of the AC plane discharge type plasma display panel.

2. Background Art

It is a recent trend that in personal computer, etc., not only display monitor of small size and thin type is demanded, but also display image of high brightness and high definition is increasingly required. To satisfy such requirements, several displays using a plasma display panel as a display device have been heretofore developed in various fields of the art, and some of them have already been put into practical use.

FIG. 9 is a partially perspective view showing a structure of a typical AC plane discharge type plasma display panel (hereinafter referred to as AC plane discharge type PDP).

In the drawing, reference numeral 1 indicates a transparent electrode, numeral 2 indicates a bus electrode of a metal for supplying a voltage to the transparent electrode 1, and numeral 11 indicates a fundamental insulating film (hereinafter referred to simply as insulating film) in which light transmission is less lowered. Numeral 3 indicates an even dielectric layer covering the transparent electrode 1 and the bus electrode 2, and numeral 4 indicates a MgO vapor deposition film (hereinafter referred to as cathode film) serving as a cathode at the time of discharge. Numeral 5 indicates a front glass substrate on which the transparent electrode 1, bus electrode 2, dielectric layer 3 and cathode film 4 formed on the insulating film 11 are mounted. These elements form a first substrate section.

Reference numeral 6 indicates a write electrode perpendicularly grade-separating the bus electrode 2, numeral 10 indicates an even graze layer covering the write electrode 6, and numeral 7 indicates a barrier rib for partitioning each individual write electrode 6. Numeral 8 indicates a fluorescent substance formed on the surface of the graze layer 10 and on the wall surface of the barrier rib 7, and subscripts R, G and B means that the fluorescent substances respectively emit fluorescent colors of red, green and blue. Numeral 9 indicates a rear glass substrate on which the mentioned elements 6, 7, 8 and 10 are mounted. These elements form a second substrate section.

Top part of the barrier rib 7 is in contact with the cathode film 4, whereby a discharge space surrounded by the fluorescent substance 8 and the cathode film 4 is formed. This discharge space is filled with a gas mixture of Xe and Ne.

In this construction, as shown in the drawing, a n-th canning line is formed by a pair of transparent electrode 1 and bus electrode 2, i.e., by a pair of electrodes Xn and Yn which sustain discharge.

Each junction at which each scanning line and write electrode 6 are grade-separated forms one discharge cell, and an AC plane discharge type PDP is formed such that a large number of discharge cells are arranged in the form of a matrix.

Generally, as disclosed in the Japanese Laid-Open Patent Publication (unexamined) 95382/1988, a glass substrate used as the front glass substrate 5 or the rear glass substrate 9 in the mentioned AC plane discharge type PDP is a soda lime glass containing about 10 to 20 weight % of sodium oxide, a glass of high distortion point containing less sodium oxide and less influenced by thermal distortion, or others.

In the front glass substrate 5, on the fundamental insulating film 11 of less reduction in light transmittance formed on the surface, a sustain electrode comprising the transparent electrode 1 and the bus electrode 2 is formed by printing process or photolithography mechanical process.

FIG. 10 is a sectional view taken along the line A–A' in FIG. 9.

With respect to the front glass substrate 5 of the AC plane discharge type PDP, as shown in FIG. 10, a glass substrate formed on the fundamental insulating film 11 of less reduction in light transmittance is generally used.

This is because surface of the glass substrate of the foundation of the transparent electrode 1 is required to be in a condition not containing any sodium oxide, and like structure is popularly adopted in the liquid crystal display (LCD) other than the AC plane discharge type PDP.

The fundamental insulating film 11 performs a function of alkali barrier to prevent that sodium oxide has a negative influence of making unstable the conductivity of the transparent electrode 1 and inhibiting the insulation between the transparent electrodes adjacent each other.

As such a fundamental insulating film 11, there is a known art in which $SiO_2$ film, $Si_3N_4$ film, $Al_2O_3$ film or the like is formed directly on the glass substrate 5 by sputtering or CVD both being a dry film formation method, as disclosed in the Japanese Laid-Open Patent Publication (unexamined) 95382/1988, for example. Generally, $SiO_2$ film of which formation is easy is popularly adopted in practical use.

In the mentioned construction, the $SiO_2$ film being the fundamental insulating film 11 is a fundamental film of the transparent electrode 1 which is a transparent conductive film of ITO, $SnO_2$, etc., and performs a function of an alkali barrier layer with respect to the front glass substrate 5.

When the layer of the fundamental insulating film 11 is thicker, effect of the alkali barrier is more improved, which is a tradeoff between the effect of alkali barrier and productivity in the formation of $SiO_2$ film.

For example, in case of LCD, when adopting a cheap soda lime glass as a base glass substrate, the fundamental $SiO_2$ film of the transparent electrode performs a necessary and sufficient alkali barrier effect as a result of obtaining a film thickness having values shown in the following Table 1 corresponding to formation method of the $SiO_2$ film.

TABLE 1

| | |
|---|---|
| When $SiO_2$ film is formed by sputtering | about 20 (nm) |
| When $SiO_2$ film is formed by CDV under normal pressure | about 50 (nm) |
| When $SiO_2$ film is formed by sol-gel method | about 100 (nm) |

In this respect, film formation by sputtering is a method for forming a $SiO_2$ film on a substrate by applying a high voltage (several kV) between a cathode to which $SiO_2$ target is attached and an anode opposite thereto in vacuum under an atmosphere of argon from $10^{-2}$Pa to $10^{0}$Pa, thereby occurring a glow discharge, and by performing a high frequency sputtering.

Film formation by CVD under normal pressure is a method for forming a $SiO_2$ film by a chemical reaction comprising the steps of heating a substrate, supplying a $SiH_4$ gas to the surface of the substrate, and decomposing and oxidizing the $SiH_4$ on the surface of the substrate.

Both sputtering and CVD belong to a dry film formation method. Further, there is a wet film formation method in which a $SiO_2$ film serving as a alkali barrier film is formed by sol-gel method, as disclosed in the Japanese Laid-Open Patent Publications (unexamined) 303916/1993 and 130307/1995. This film formation by sol-gel method is a method, in which a solution for forming $SiO_2$ containing a catalyst for accelerating hydrolysis reaction and condensation by applying water to silicon alkoxide such as a monomer $(C_2H_5O)_4Si$ of tetraethoxysilane is applied to a substrate composed of a soda lime glass by dipping, roll coating, etc., thereby forming a film, and after drying the film, a $SiO_2$ film is obtained by baking at a temperature of about 500.

Also in the AC plane discharge type PDP, on condition hat the transparent electrodes 1 are not coated with a glass material mainly composed of a lead oxide in the display area as in a DC refresh type PDP, for example, and that there is a less potential difference between the transparent electrodes adjacent each other, the $SiO_2$ film thickness satisfying the mentioned requirements for LCD can perform a sufficient function, even when a soda lime glass containing 10 to 20 weight % of sodium oxide is formed into a base substrate.

When applying such a $SiO_2$ film, however, it was found that there was a problem in the aspect of durability of display quality of the PDP considering an accumulated time of use thereof.

First, when making an evaluation using a $SiO_2$ film of 50 nm in thickness formed by CVD under normal pressure, it was found that life in practical use was in the range of only 500 hours to 1,000 hours.

Then, it was also found that when making an evaluation using a $SiO_2$ film of 100 nm in thickness formed by sol-gel method, there was a durability of the same level.

As a result of examining the cause of such a short life, following problems were acknowledged.

Generally, during the period of writing operation occupying a large portion of time in memory driving, a dc voltage mounting from 100 V to 150 V are applied almost at all times between the n-th sustain electrode Xn and the sustain electrode Yn, and a gap between the sustain electrode Xn and the sustain electrode Yn is so small as to be not larger than 100 $\mu$m. Therefore, a strong one-directional electric field acts on the gap portion for most of the time.

As this electric field acts on sodium ion from sodium oxide in the front glass substrate 5, uneven distribution of sodium ion of negative polarity (on the sustain electrode Yn side in this case) becomes remarkable with the passage of time. Thus, sodium component reaching the dielectric layer 3 passing through the $SiO_2$ film is increased.

The unevenly distributed sodium ion reduces the lead oxide in the dielectric layer 3 and precipitates a lead. It is this lead that occurs a migration in which sodium ion is diffused from the base substrate (the front glass substrate 5) and grows from the sustain electrode Yn toward the sustain electrode Xn.

As a result of occurrence of such a migration, even though the applied voltage between the sustain electrode Xn and the sustain electrode Yn is equal, with the passage of time, a distortion arises in the distribution of electric field between the sustain electrode Xn and the sustain electrode Yn. This distortion brings about a large variation in discharge characteristic eventually resulting in disorder in display or lack of stability.

Particularly in the screen of high display rate, temperature of panel is raised, and the mentioned migration remarkably proceeds.

Then, for the purpose of lowering the manufacturing cost, when using a silver of thick film for easy formation of electrode film as a material of the bus electrode 2, color of the bus electrode portion was changed to yellow when watching from the watching side of display of the AC plane discharge type PDP. And in most case, display quality of screen was remarkably deteriorated.

It was acknowledged that this was a following phenomenon. That is, generally, the substrate composed of a soda lime glass formed by floating method contains a metal Sn on the surface. Therefore, when using such a substrate as the front glass substrate 5 serving as the base substrate, with the passage of heat history in the panel formation process, the metal Sn and the silver in the bus electrode are diffused in such a manner as penetrating in direction of thickness of the transparent electrode 1 and the $SiO_2$ film, and react on each other to produce a silver colloid. And this silver colloid produced by the reaction develops the yellow color.

In addition, the substrate composed of a soda lime glass formed by the floating method has a bottom surface containing relatively a large amount of Sn and a top surface containing relatively a small amount of Sn. When using such a bottom surface side as a base, the mentioned color change to yellow becomes considerable finally presenting a brown color. Furthermore, the color change to yellow extends to the light transmission portion having no bus electrode 2, and light transmission characteristic itself of the front glass 5 is deteriorated. Such a substrate cannot be substantially used.

On the other hand, when using the mentioned top surface as a base, there is certainly an advantage that the mentioned color change to yellow is confined only to the bus electrode portion, and the extent of the color change to yellow is relatively a little. But the color change to yellow appears in the form of macroscopically uneven concentration of color on the display screen, which deteriorates the display quality of the picture screen after all.

In addition, it was found that the uneven concentration of color was caused by a film quality of the transparent electrode 1.

Because, when forming the transparent electrode 1 of a $SnO_2$ film by CVD under normal pressure, a significant difference was acknowledged between the following steps (A) and (B).

(A) After forming a $SnO_2$ film by CVD under normal pressure on a $SiO_2$ film on which the transparent electrode 1 and a resist pattern of inverted shape have been formed, the resist pattern was removed, whereby a desired pattern of the transparent electrode 1 was obtained. (lift-off method)

(B) The transparent electrode 1 and a resist pattern of the same shape were formed on a $SiO_2$ film on which a $SnO_2$ film has been formed by CVD under normal pressure. Then, unnecessary portion thereof was removed by chemical etching, and thereafter the resist was removed, whereby a desired pattern of the transparent electrode 1 was obtained. (etching method).

As a result of comparison, it was acknowledged that in the panel obtained by the lift-off method (A), uneven concentration of color appears clearly in most case, while in the panel obtained by the etching method (B), such uneven concentration of color does not appears substantially.

It is presumed that in the lift off method (A), the film is formed under an atmosphere in which at the time of forming the $SnO_2$ film by CVD under normal pressure, the resist is exposed to a high temperature and partially burnt. Therefore, there is a possibility that uneven distribution of combustion components due to gas flow at the time of performing the CVD under normal pressure gives an influence to the film quality of the $SnO_2$ film.

In particular, when sodium in the soda lime glass is partially diffused and reaches the surface where the resist is closely adhered, due to increase of temperature of the glass substrate during the CVD of the $SnO_2$ film under normal pressure, the adhesion of the resist is lost and the resist is peeled off the surface of the substrate. As a result, it is presumed that the resist is burnt more briskly, and the irregularity or unevenness in film quality of the $SnO_2$ film becomes more remarkable.

In this respect, the term "film quality of $SnO_2$ film" is defined by following two factors:

(1) a barrier effect on the metal Sn in the base substrate or on the silver in the bus electrode, or (2) a composition ratio in the film of the components deposited not in the form of $SnO_2$ molecule but in the form of metal Sn in the CVD of the $SnO_2$ film under normal pressure. (A mechanism is supposed in which when the composition ratio of the metal Sn in the $SnO_2$ film is large, this metal Sn comes in contact with the silver of the bus electrode 2 without barrier, whereby the color is changed to yellow.)

The present invention was made to solve the above-discussed problems and has an object of achieving an AC plane discharge type PDP capable of providing a display screen of high definition and high reliability, in which even when a glass containing sodium oxide such as soda lime glass is used as the front glass substrate 5 serving as a base substrate of the first substrate section on the display side of the AC plane discharge type PDP, the color change of the glass substrate to yellow or uneven concentration of color in the yellow after heat history in the step of forming a panel is declined, and even at the time of operation at a high temperature, progress of the migration occurred due to behavior of sodium in the glass substrate is retarded.

Another object of the invention is to achieve an AC plane discharge type PDP of high definition, high reliability and of high productivity.

SUMMARY OF THE INVENTION

An AC plane discharge type plasma display panel according to a first invention comprises a first substrate section having a picture screen and a second substrate section arranged opposite to the first substrate section, and in which a desired picture is displayed by a gas discharge in plural discharge cells formed between the first substrate section and the second substrate section, characterized in that the first substrate section comprises:

a glass substrate containing sodium oxide serving as a base of the first substrate section;

an insulating film being a $SiO_2$ layer having not less than about 100 nm in thickness and formed by dry film formation method on the surface of the second substrate section of the glass substrate;

plural pairs of discharge sustain electrodes each comprising a transparent electrode and a bus electrode, formed on the insulating film, and arranged in parallel with a predetermined distance between one pair and another;

a dielectric layer formed on the insulating film in such a manner as to cover the plural pairs of discharge electrodes; and a cathode film formed on the dielectric layer.

As a result of above construction, even when the insulating film of $SiO_2$ layer serving as a foundation for forming the transparent electrodes by dry film formation method on the AC plane discharge type PDP, alkali barrier effect can be maintained for a long time. Accordingly, progress of migration can be dull, and an AC plane discharge type PDP of high durability can be achieved.

An AC plane discharge type plasma display panel according to a second invention comprises a first substrate section having a picture screen and a second substrate section arranged opposite to the first substrate section, and in which a desired picture is displayed by a gas discharge in plural discharge cells formed between the first substrate section and the second substrate section, characterized in that the first substrate section comprises:

a glass substrate containing sodium oxide serving as a base of the first substrate section;

an insulating film being a $SiO_2$ layer having not less than about 200 nm in thickness and formed by wet film formation method on the surface of the second substrate section of the glass substrate;

plural pairs of discharge sustain electrodes each comprising a transparent electrode and a bus electrode, formed on the insulating film, and arranged in parallel with a predetermined distance between one pair and another;

a dielectric layer formed on the insulating film in such a manner as to cover the plural pairs of discharge electrodes; and a cathode film formed on the dielectric layer.

As a result, even when the insulating film of the $SiO_2$ layer serving as a foundation for forming the transparent electrodes by wet film formation method on the AC plane discharge type PDP, alkali barrier effect can be maintained for a long time. Accordingly, progress of migration can be dull, and an AC plane discharge type PDP of high durability can be achieved.

In the AC plane discharge type plasma display panel according to a third invention or fourth invention, the bus electrode as defined in the mentioned first or second invention is formed using silver of thick film.

As a result, productivity of the bus electrode formation step is improved, and a PDP of high productivity is achieved at a reasonable cost.

Further, as the insulating film of the $SiO_2$ layer can maintain the alkali barrier effect for a long time, progress of migration can be retarded.

The improvement in alkali barrier effect of the insulating film of the mentioned $SiO_2$ layer further brings about an improvement in barrier effect on the diffusion of the metal Sn contained in the mentioned silver or on the surface of the front glass substrate when silver of thick film is used as the bus electrode. Accordingly, as the production of silver colloid can be restrained, the mentioned color change to yellow in the bus electrode portion can be declined.

When the transparent electrode is obtained by the mentioned lift-off method, the function of preventing that sodium of the soda lime glass reaches the surface where the resist is closely adhered during the production of the $SnO_2$ film (i.e., transparent film) is improved. As a result, unevenness in film quality of the $SnO_2$ film (i.e., transparent film) is reduced, and the uneven concentration of color in the color change to yellow of the bus electrode portion can be declined.

DETAILED DESCRIPTION OF THE PREFERRED EMBODIMENT

An AC plane discharge type plasma display according to the invention is hereinafter specifically described with reference to the drawings.

EXAMPLE 1

Example 1 according to the invention is hereinafter described with reference to FIGS. 1, 2, 3, 4 and Table 2.

Figure 8:
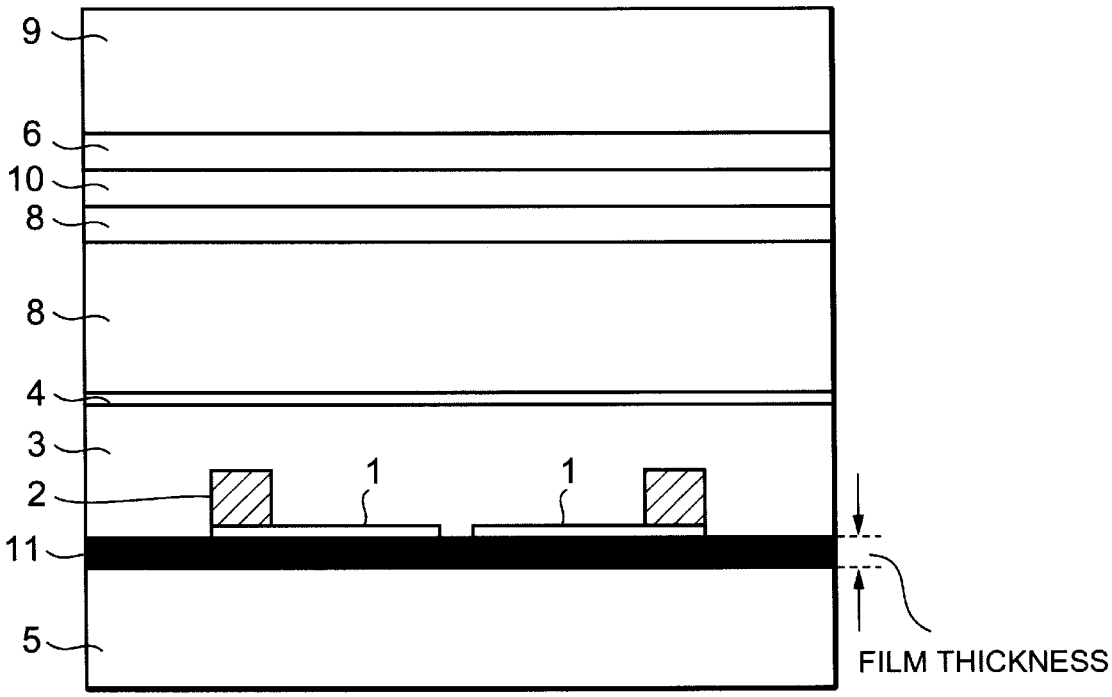
FIG. 8 is a sectional view of a discharge cell structure showing a feature of the first and second examples.

FIG. 8 is a sectional view of a discharge cell structure showing a feature of the first and second examples.

Figure 9:
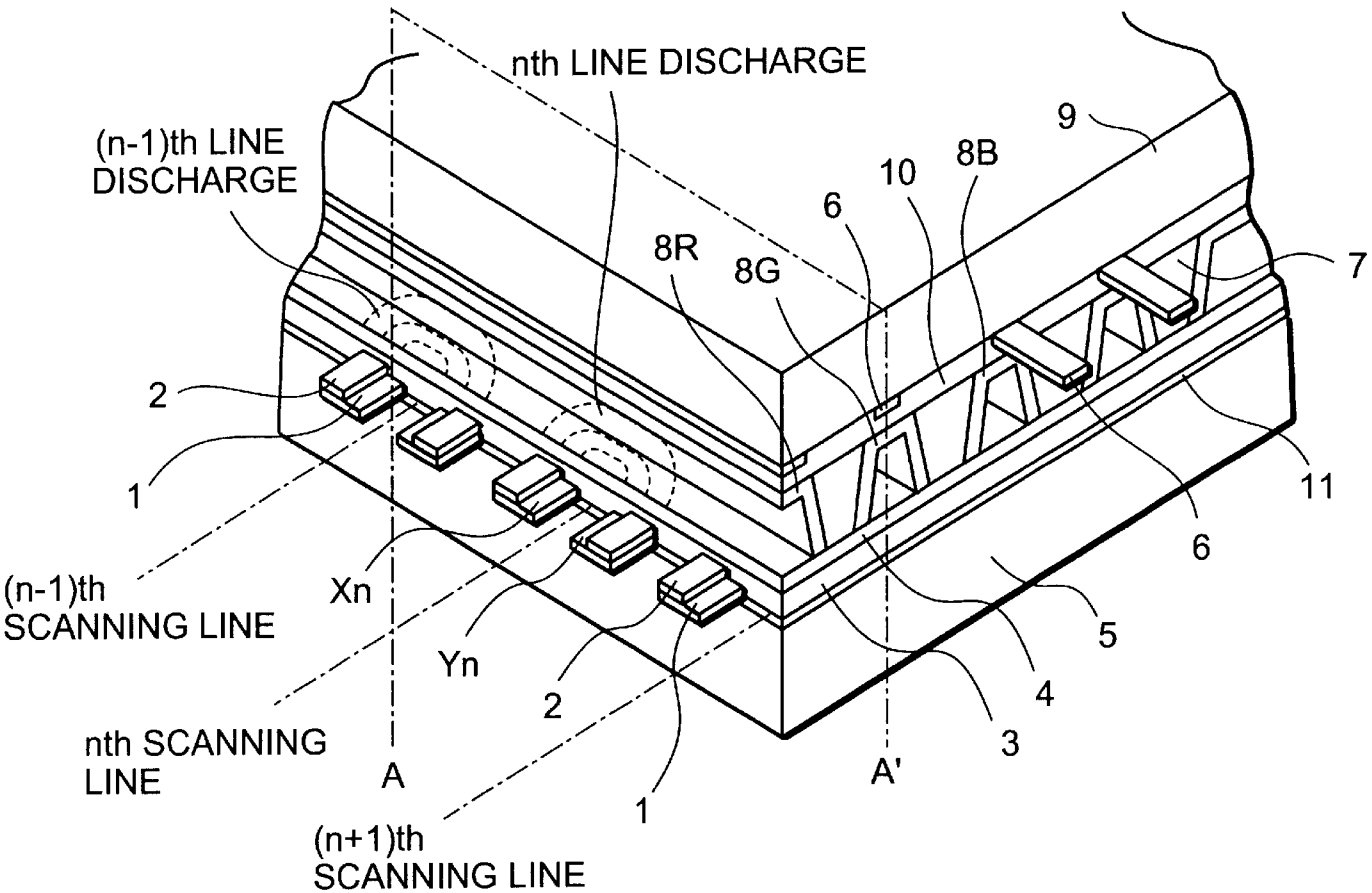
FIG. 9 is a partially perspective view of a typical AC plane discharge type PDP.
Figure 10:
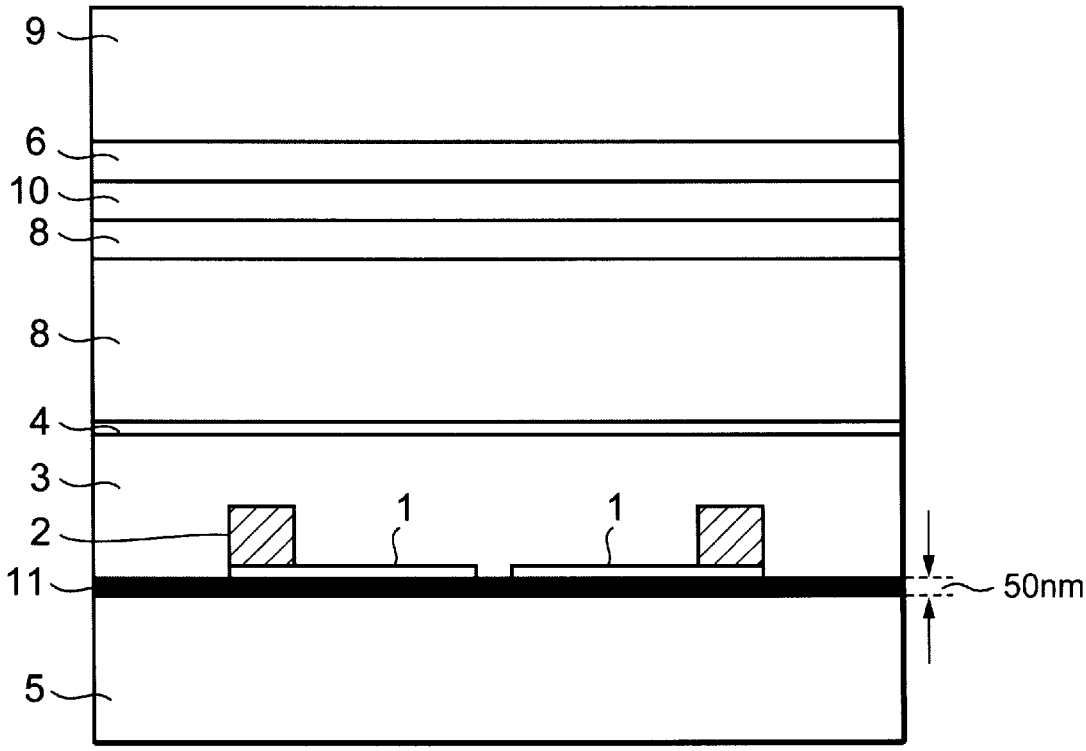
FIG. 10 is a sectional view of the conventional AC plane discharge type PDP formed with a fundamental insulating film thickness.

It is to be noted that the basic structure of the AC plane discharge type PDP according to this example is same as that shown in FIG. 9. Characteristics of this example consist in formation method of the fundamental insulating film 11, film thickness, material of the bus electrode, and conditions of combination thereof.

This example provides an AC plane discharge type plasma display for displaying a desired picture in accordance with a gas discharge in a discharge cell formed between a first substrate section and a second substrate section opposite to each other, said first substrate section comprising:

a. a $SiO_2$ layer having not less than 100 nm in thickness in the direction opposite to the mentioned second substrate formed by CVD under normal pressure to serve as a fundamental insulating film 11;

b. pairs (Xn, Yn) of discharge sustain electrodes comprising a transparent electrode 1 and at least one bus electrode 2 containing silver each pair being arranged along a display line on the mentioned fundamental insulating film in parallel with a predetermined distance between one pair and another; and c. a dielectric layer 3 provided in such a manner as to cover the mentioned pairs of discharge sustain electrodes, and a cathode film 4 provided in such a manner as to cover the dielectric layer 3;

the mentioned $SiO_2$ layer, pairs of discharge sustain electrodes, dielectric layer and cathode layer being arranged on a front glass substrate 5 having a top surface of the substrate composed of a soda lime glass containing about 15 weight % of sodium oxide on the opposite side of the second substrate section, and said second substrate section comprising:

at least barrier ribs 7 forming a discharge space provided on the opposite side of the mentioned first substrate section.

As a result of forming the $SiO_2$ layer having not less than 100 nm in thickness on the soda lime glass by CVD under normal pressure to serve as the fundamental insulating film 11, it is possible to prevent that the metal Sn and silver ion contained in the substrate are diffused passing through the $SiO_2$ film during the heat history in the panel formation process.

The fundamental insulating film 11 also serves as a fundamental film of the transparent electrode 1 formed in the next process. And by forming the $SiO_2$ layer having not less than 100 nm in thickness on the substrate of a soda lime glass by CVD under normal pressure, it is possible to grow stably a transparent conductive film (i.e., transparent film 1).

When a $SiO_2$ film serving as the fundamental insulating film 11 of the transparent electrode 1 is formed to have a thickness of not less than 100 nm by CVD under normal pressure being one of dry film formation methods, following specific advantages are performed.

First, the transparent electrode 1 is formed by the following steps (1) to (4).

(1) A $SiO_2$ film serving as the fundamental insulating film 11 of 100 nm in thickness is formed on the entire surface of the front glass substrate 5 (for example, about 100 cm in diagonal dimensions) by CVD under normal pressure.

(2) An inverted pattern of the transparent electrode 1 is formed with a resist after a photolithographic process.

(3) A $SnO_2$ film being a transparent electrode material is formed on the inverted pattern by CVD under normal pressure.

(4) The inverted pattern formed with the resist is lifted off, whereby a transparent electrode 1 is obtained.

In the mentioned steps of forming the transparent electrode, just by increasing the thickness of the $SiO_2$ layer from 50 nm to 100 nm without changing the conditions of forming the $SnO_2$ film, it became possible to increase the thickness of the transparent electrode 1 by about 15 to 20%.

This means that by increasing the thickness of the $SiO_2$ film being the fundamental insulating film, growth of the $SnO_2$ film (i.e., transparent film 1) became easy.

It was also acknowledged that irregularity in film thickness represented by a difference between maximum value and minimum value of the thickness of the $SiO_2$ film (i.e., transparent film 1) was reduced.

Accordingly, as compared with the transparent electrode 1 ($SnO_2$ film) formed on the fundamental insulating film 11 ($SiO_2$ film) having the conventional thickness (50 nm), the transparent electrode 1 ($SnO_2$ film) formed on the fundamental insulating film 11 ($SiO_2$ film) of 100 nm in thickness can reduce significantly occurrence of the problem (of uneven film quality) incidental to the $SnO_2$ film (i.e., transparent film 1).

When the bus electrode 2 containing a silver component formed of a material such as thick film silver, if there is any uneven film quality in the transparent electrode 1 being a transparent conductive film, uneven diffusion of the silver component occurs in the heat history during the process of forming a panel, whereby irregular fringes of yellow color change takes place on the surface of the glass substrate.

However, as a result of increasing thickness of the $SiO_2$ layer being the fundamental insulating film 11 formed by a dry film formation method such as CVD under normal pressure from 50 nm to 100 nm, the uneven film quality of the transparent conductive film is restrained, as suggested by improvement in increase of film thickness of the transparent conductive film and in reduction of unevenness of film thickness. Thus, occurrence of irregular fringes of yellow color change in the bus electrode 2 portion is considerably restrained.

Figure 1:
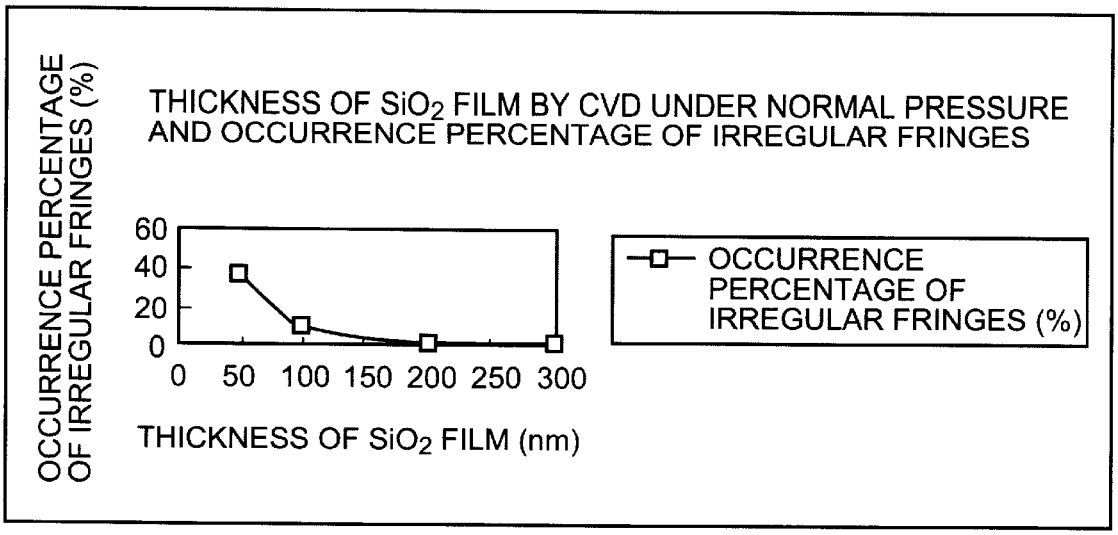
FIG. 1 is a graph showing a relation between film thickness of a $SiO_2$ film formed by CVD under normal pressure and occurrence of irregular fringes according to a first example of the invention.

FIG. 1 is shows a result obtained through an experiment on a relation between film thickness of a $SiO_2$ film (i.e., fundamental insulating film 11) formed by CVD under normal pressure and occurrence of irregular fringes.

That is, FIG. 1 shows a result of a test in which a sample of front panel (40 inches in diagonal dimensions) for AC plane discharge type PDP is actually prepared, and occurrence rate of irregular fringes are counted while changing thickness of $SiO_2$ film. In the drawing, axis of abscissas indicates thickness of $SiO_2$ film, and axis of ordinates indicates occurrence frequency of irregular fringes.

As shown in FIG. 1, as a result of forming a thickness of $SiO_2$ film to be not less than 100 nm by CVD under normal pressure, occurrence frequency of irregular fringes is lowered. It is also acknowledged that effect of the improvement due to increase in film thickness of the $SiO_2$ film (i.e., fundamental insulating film 11) is remarkable.

Figure 2A:
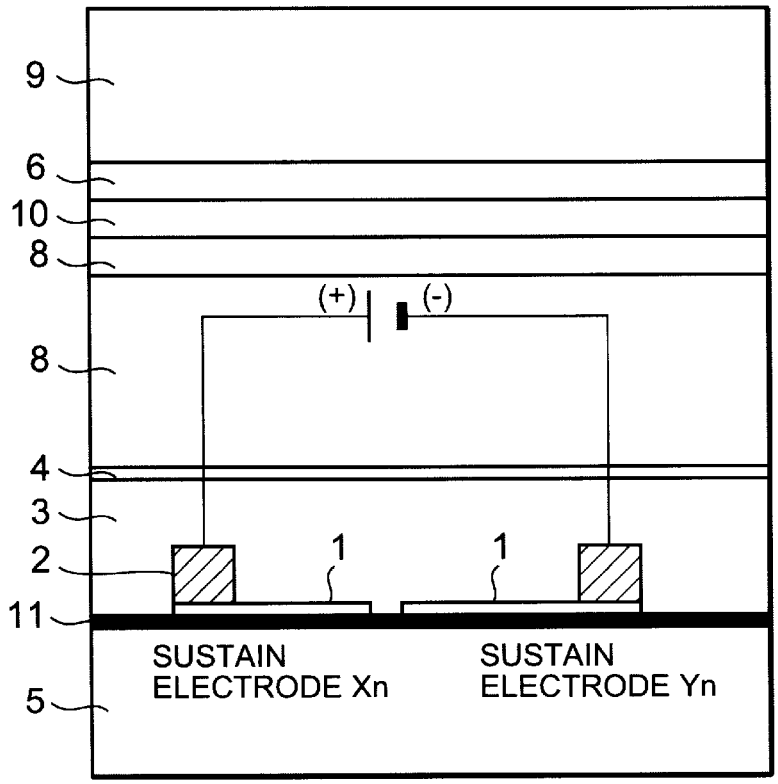
FIGS. 2 (A) and (B) are schematic views respectively showing a method of experiment for acknowledging a thickness of the $SiO_2$ film formed by CVD under normal pressure and occurrence of migration, and a progress of migration in the first example.
Figure 2B:
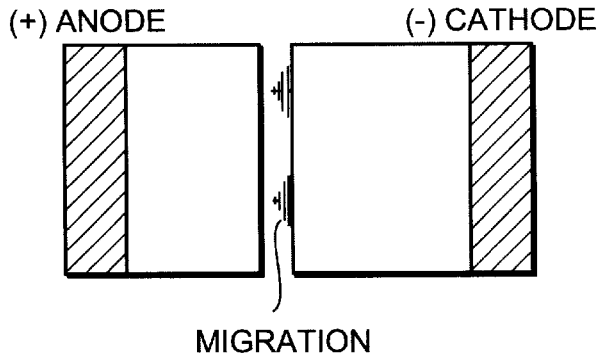

FIGS. 2 (A) and (B) are schematic views to explain the principle of occurrence of migration between one transparent electrode 1 and another. The transparent electrode 1 serves as a sustain electrode.

When occurring a migration between a pair discharge sustain electrodes and another (i.e., between the transparent electrodes), as shown in FIG. 2 (B), an effective discharge gap is narrowed by a conductive substance that might be a metal lead growing like a whisker between the pairs of sustain electrodes (i.e., between the transparent electrodes).

Consequently, since electrostatic capacity between the sustain electrode Xn and the sustain electrode Yn in the discharge cell is in inverse proportion to the discharge gap, the electrostatic capacity between the sustain electrode Xn and the sustain electrode Yn in the discharge cell is increased with the progress of migration between the sustain electrodes.

Figure 3:
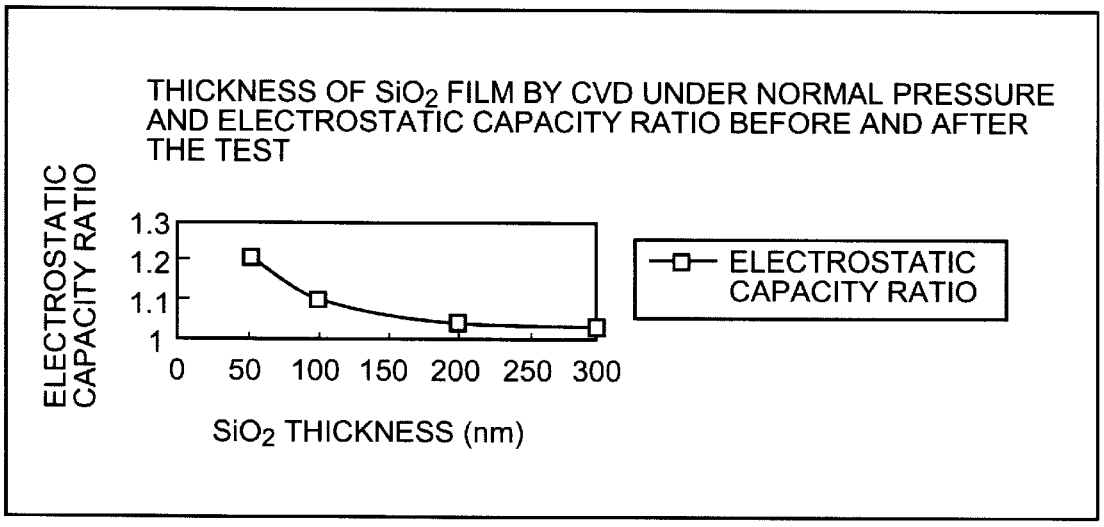
FIG. 3 is a graph showing a relation between film thickness of a $SiO_2$ film formed by CVD under normal pressure and occurrence of migration in the first example.

A test was performed for ten hours on the testing conditions of progress of migration shown in Table 2. FIG. 3 shows a result of measuring variation in electrostatic capacity before and after the test.

In FIG. 3, axis of abscissas indicates thickness of $SiO_2$ film formed by CVD under normal pressure, and axis of ordinates indicates electrostatic capacity ratio (a value obtained by dividing an electrostatic capacity after the test by an electrostatic capacity before the test).

FIG. 3 shows that when the electrostatic capacity ratio is nearer to 1, progress of migration is less, which represents that discharge cell is in a desirable state. Thus, it is understood from FIG. 3 that when the $SiO_2$ film is formed to be thicker than 100 nm, the electrostatic capacity ratio is nearer to 1, and progress of migration is restrained.

TABLE 2

| | |
|---|---|
| Base substrate | Substrate composed of soda lime glass for building material containing about 15 weight % of sodium oxide. Top side is used as base. |
| Electrode | Transparent electrode and sustain electrode composed of metal electrode containing silver |
| Dielectric layer | Glass containing lead oxide |
| Testing temperature | 80° C. |
| Voltage applied between sustain electrode Xn and sustain electrode Yn | DC200V |

Figure 4:
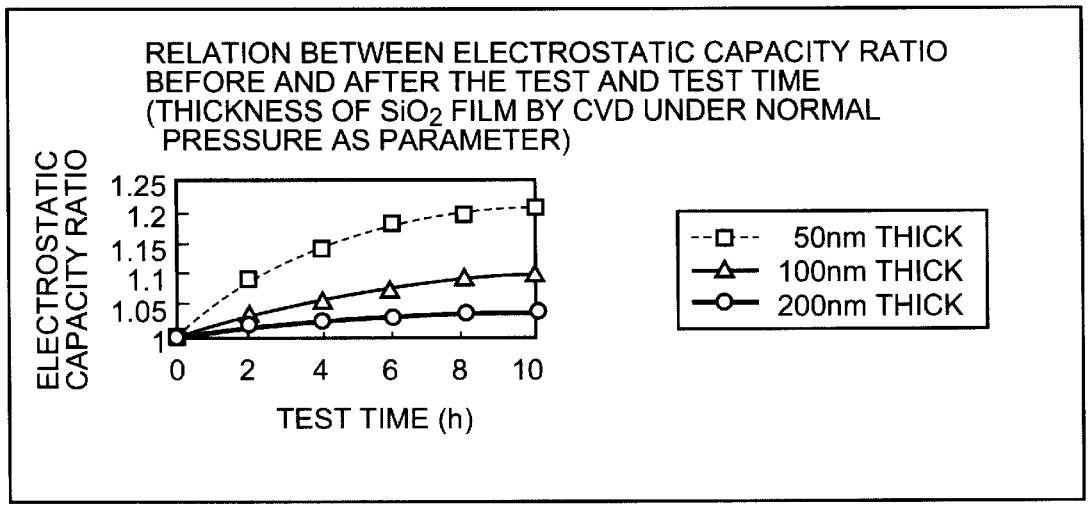
FIG. 4 is a graph showing a progress of migration with the passage of test time using a film thickness of the $SiO_2$ film formed by CVD under normal pressure as a parameter in the first example.

FIG. 4 shows a result of measurement of a progress of migration with the passage of test time when using film the thickness of a $SiO_2$ film formed by CVD under normal pressure as a parameter on the testing conditions shown in Table 2.

In the drawing, when the test is performed for 2 hours, for example, electrostatic capacity ratio is a value obtained by dividing an electrostatic capacity after two hours from starting the test by an electrostatic capacity at the time of starting the test.

It is understood that at the time of starting the test, as there is no influence by migration, electrostatic capacity ratio is 1, and with the passage of time, migration starts and electrostatic capacity ratio increases gradually from 1.

Looking into the relation between electrostatic capacity ratio and passage of time of the thickness of the $SiO_2$ film formed by CVD under normal pressure, it is understood that when the thickness $SiO_2$ film is increased more, variation in electrostatic capacity ratio with the passage of time is less, and progress of migration is restrained.

Studying specifically the effect of improvement, electrostatic capacity ratio after passing 2 hours when thickness of $SiO_2$ film=50 (nm) is almost equal to electrostatic capacity ratio after passing 10 hours when thickness of $SiO_2$ film= 100 (nm) . And electrostatic capacity ratio after passing 2.5 hours when thickness of $SiO_2$ film=100 (nm) is almost equal to electrostatic capacity ratio after passing 10 hours when thickness of $SiO_2$ film=200 (nm) . In other words, by increasing the thickness of $SiO_2$ film from 50 nm to 100 nm, it is achieved that durability or life that has been short due to occurrence of migration is extended by about five times as compared with the life when thickness of $SiO_2$ film=50 (nm) . Further, by increasing the thickness of $SiO_2$ film to 200 nm, it is achieved that durability or life is extended by about twenty times as compared with the life when thickness of $SiO_2$ film=50 (nm).

When thickness of the SiO2 film formed by CVD under normal pressure is 50 nm, actual life is in the range of 500 to 1,000 hours. Accordingly, when estimated on the mentioned result, in the case that thickness of $SiO_2$ film=100 (nm), actual life is in the range of 2,500 to 5,000 hours, and in the case that thickness of $SiO_2$ film=200 (nm), actual life is in the range of 10,000 to 20,000 hours.

As described above, as a result of changing the thickness of the fundamental insulating film 11 (i.e., $SiO_2$ film) formed by CVD under normal pressure from conventional 50 nm to not less than 100 nm, barrier function is improved due to thermal diffusion of metal Sn contained in the soda lime glass and silver component of the bus electrode 2.

Consequently, film quality of the transparent conductive film forming the transparent electrode 1 on the fundamental insulating film 11 (i.e., $SiO_2$ film) is uniformed.

By synergism between the improvement in barrier function of the $SiO_2$ film serving as the fundamental insulating film and the uniformity in film quality of the transparent conductive film (i.e., $SnO_2$ film) forming the transparent electrode 1, the color change of the glass substrate to yellow is remarkably restrained.

Furthermore, as a result of forming the fundamental insulating film 11 (i.e., $SiO_2$ film) formed by CVD under normal pressure to have a thickness not less than 100 nm, even when dc voltage component occupies a large portion of time at the time of writing, as is done in AC plane discharge type PDP, life is much extended as compared with the conventional thickness of $SiO_2$ film formed by CVD under normal pressure.

In addition, though any experiment in which a $SiO_2$ film is formed by sputtering is not carried out in this example, as shown in Table 1, a necessary and sufficient alkali barrier effect is achieved even if thickness of the $SiO_2$ film is smaller than that formed by CVD under normal pressure.

Since the mentioned remarkable improvement is achieved by increasing thickness of the $SiO_2$ film to not less than 100 nm by CVD under normal pressure, it is easily presumed that when the $SiO_2$ film is formed by sputtering to have a thickness of not less than 100 nm, more significant improvement is achieved.

Further, even when the $SiO_2$ film is formed by vacuum deposition or by plasma CVD, a common mechanism of deposition of $SiO_2$ molecule is operated under vacuum. Therefore, in the aspect of film quality affecting on the alkali barrier effect such as film composition, film density, the same quality level as that by sputtering is achieved.

EXAMPLE 2

Example 2 according to the invention is hereinafter described with reference to FIGS. 5, 6, 7 and Table 2.

A structure of discharge cell showing a characteristic of the invention is shown in FIG. 8.

It is to be noted that, in the same manner as in Example 1, the basic structure of the AC plane discharge type PDP according to this example is same as that shown in FIG. 9. Characteristics of this example consist in formation method of the fundamental insulating film 11, film thickness, material of the bus electrode, and condition of combination.

This example provides an AC plane discharge type plasma display for displaying a desired picture in accordance with a gas discharge in a discharge cell formed between a first substrate section and a second substrate section opposite to each other, said first substrate section comprising:

a. a $SiO_2$ layer having not less than 200nm in thickness in the direction opposite to the mentioned second substrate formed by sol-gel method being one of wet film formation methods to serve as a fundamental insulating film 11;

b. pairs (Xn, Yn) of discharge sustain electrodes comprising a transparent electrode 1 and at least one bus electrode 2 containing silver each pair being arranged along a display line on the mentioned fundamental insulating film 11 in parallel with a predetermined distance between one pair and another; and c. a dielectric layer 3 provided in such a manner as to cover the mentioned pairs of discharge sustain electrodes, and a cathode film 4 provided in such a manner as to cover the dielectric layer 3;

the mentioned $SiO_2$ layer, pairs of discharge sustain electrodes, dielectric layer and cathode layer being arranged on a front glass substrate 5 having a top surface of the substrate composed of a soda lime glass containing about 15 weight % of sodium oxide on the opposite side of the second substrate section, and said second substrate section comprising:

at least barrier ribs 7 forming a discharge space provided on the opposite side of the mentioned first substrate section.

As a result of forming the $SiO_2$ layer having not less than 200 nm in thickness on the soda lime glass by sol-gel method to serve as the fundamental insulating film 11, it is possible to prevent that the metal Sn and silver ion contained in the substrate are diffused passing through the $SiO_2$ film during heat history in the panel formation process. And it is possible to restrain that the glass substrate changes the color to yellow.

The fundamental insulating film 11 also serves as a fundamental film of the transparent electrode 1 formed in the next process. And by forming the $SiO_2$ layer having not less than 200 nm in thickness on the substrate of soda lime glass by sol-gel method, it is possible to grow stably a transparent conductive film (i.e., transparent film 1).

When a $SiO_2$ film being the fundamental insulating film 11 of the transparent electrode is formed to have a thickness of not less than 200 nm by sol-gel method being one of wet film formation methods, following specific advantages are achieved.

First, the transparent electrode 1 is formed by the following steps (1) to (4).

(1) A $SiO_2$ film being the fundamental insulating film 11 of 200 nm in thickness is formed on the entire surface of the front glass substrate 5 (for example, about 100 cm in diagonal dimensions) by sol-gel method.

(2) Inverted pattern of the transparent electrode 1 is formed with a resist after a photolithographic process.

(3) A $SnO_2$ film being a transparent electrode material is formed on the inverted pattern by CVD under normal pressure.

(4) The inverted pattern formed with the resist is lifted off, whereby a transparent electrode 1 is obtained.

In the mentioned steps of forming the transparent electrode, just by increasing thickness of the $SiO_2$ layer from the conventional 100 nm to 200 nm without changing the conditions of forming the $SnO_2$ film, it became possible to increase thickness of the transparent electrode.

This means that by increasing the thickness of $SiO_2$ film being the fundamental insulating film, growth of the $SnO_2$ film (i.e., transparent film 1) became easy.

It was also acknowledged that unevenness in film thickness represented by a difference between maximum value and minimum value of the film thickness of the $SiO_2$ film (i.e., transparent film 1) was reduced.

Accordingly, as compared with the transparent electrode 1 ($SnO_2$ film) formed on the fundamental insulating film 11 ($SiO_2$ film) of the conventional thickness (100 nm), the transparent electrode 1 ($SnO_2$ film) formed on the fundamental insulating film 11 ($SiO_2$ film) of 200 nm in thickness can reduce significantly occurrence of the problem (of uneven film quality) incidental to the $SnO_2$ film (i.e., transparent film 1).

When the bus electrode 2 containing a silver component formed of a material such as thick film silver, if there is any uneven film quality in the transparent electrode 1 being a transparent conductive film, uneven diffusion of the silver component occurs in heat history during the process of forming a panel, whereby irregular fringes of yellow color change takes place on the surface of the glass substrate.

However, by increasing thickness of the $SiO_2$ layer being the fundamental insulating film 11 formed by a wet film formation method such as sol-gel method from 100 nm to 200 nm, the uneven film quality of the transparent conductive film is restrained as suggested by improvement in increase of film thickness of the transparent conductive film and in reduction of unevenness of film thickness, whereby occurrence of irregular fringes of yellow color change in the bus electrode 2 portion is considerably restrained.

Figure 5:
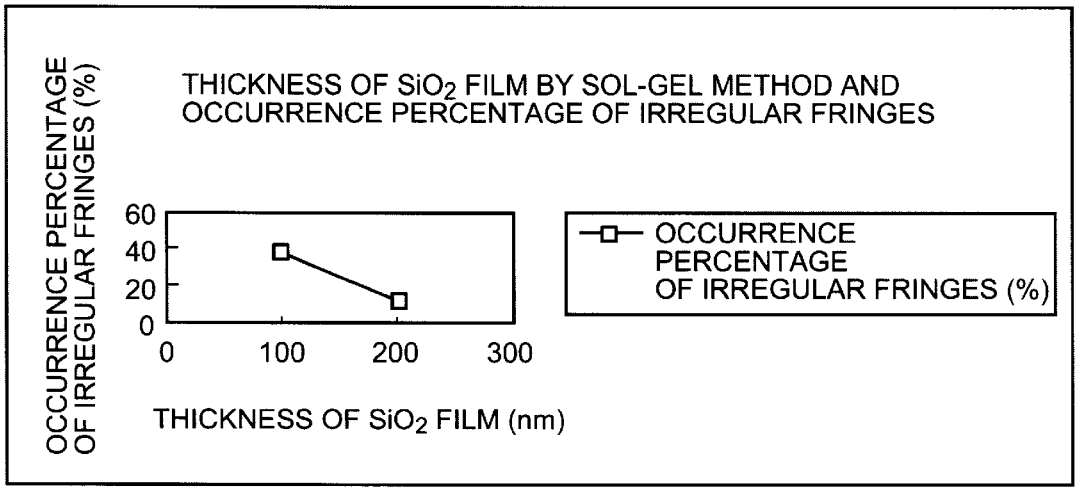
FIG. 5 is a graph showing a relation between film thickness of a $SiO_2$ film formed by sol-gel method and occurrence of irregular fringes according to a second example of the invention.

FIG. 5 is shows a result obtained through an experiment on a relation between film thickness of a $SiO_2$ film (i.e., fundamental insulating film 11) formed by sol-gel method and occurrence rate of irregular fringes.

FIG. 5 shows a result of a test in which a sample of front panel (40 inches in diagonal dimensions) for AC plane discharge type PDP is actually prepared, and occurrence rate of irregular fringes are counted while changing thickness of $SiO_2$ film. In the drawing, axis of abscissas indicates thickness of $SiO_2$ film, and axis of ordinates indicates occurrence frequency of irregular fringes.

As shown in FIG. 5, by changing a thickness of $SiO_2$ film from the conventional 100 nm to 200 nm, occurrence frequency of irregular fringes is lowered, and effect of the improvement due to increase in film thickness of the $SiO_2$ film is acknowledged.

It is easily presumed that when the $SiO_2$ film is formed to have a thickness of not less than 200 nm, more significant improvement is achieved.

A test was performed for ten hours on the testing conditions of the progress of migration shown in Table 2, in the same manner as the experiment in FIG. 3. FIG. 6 shows a result of measurement of variation in electrostatic capacity before and after the test.

Figure 6:
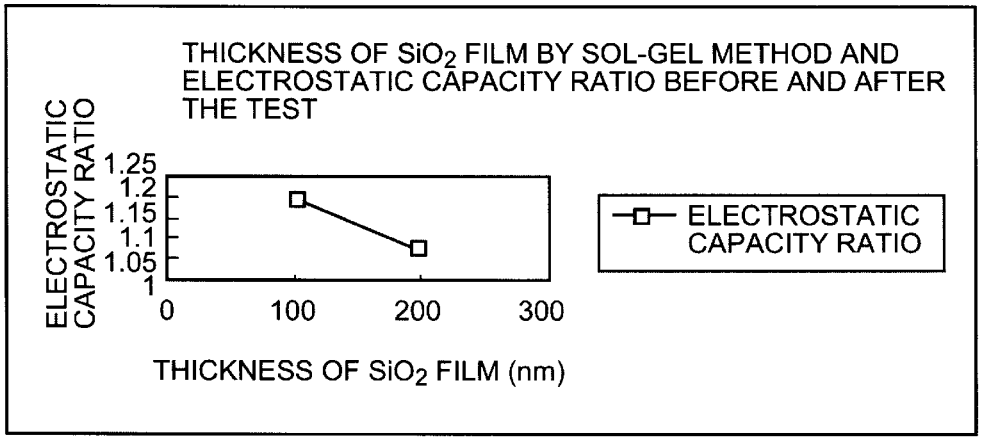
FIG. 6 is a graph showing a relation between film thickness of a $SiO_2$ film formed by sol-gel method and occurrence of migration in the second example.

In FIG. 6, axis of abscissas indicates thickness of $SiO_2$ film, and axis of ordinates indicates electrostatic capacity ratio (a value obtained by dividing an electrostatic capacity after the test by an electrostatic capacity before the test).

FIG. 6 shows that when the electrostatic capacity ratio is nearer to 1, progress of migration is less, which represents that discharge cell is in a desirable state. Thus, it is understood from FIG. 6 that when the $SiO_2$ film is formed thicker from the conventional 100 nm to 200 nm, progress of migration is restrained.

Figure 7:
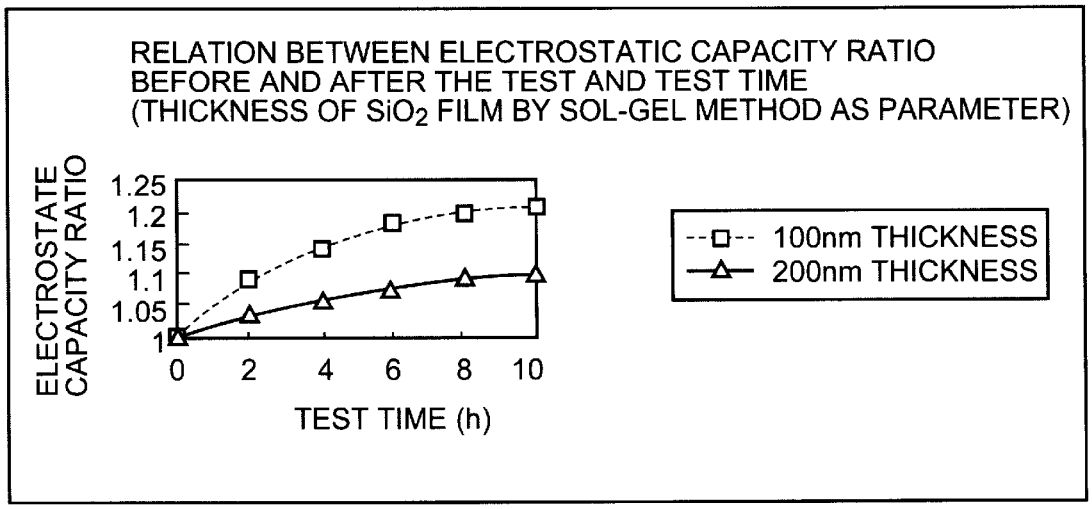
FIG. 7 is a graph showing a progress of migration with the passage of test time using thickness of a $SiO_2$ film formed by sol-gel method as a parameter in the second example.

FIG. 7 shows a progress of migration with the passage of time using thickness of a $SiO_2$ film formed by sol-gel method under the testing condition shown in Table 2 as a parameter in the second example, in the same manner as FIG. 4.

Looking into the relation between electrostatic capacity ratio and passage of time as to the thickness of $SiO_2$ film, it is understood that when the thickness $SiO_2$ film is increased larger, variation in electrostatic capacity ratio with the passage of time is less, and progress of migration is restrained.

Studying specifically the effect of improvement, electrostatic capacity ratio after passing 2 hours when thickness of $SiO_2$ film=100 (nm) is almost equal to electrostatic capacity ratio after passing 8 hours when thickness of $SiO_2$ film=200 (nm).

In other words, by increasing the thickness of $SiO_2$ film from 100 nm to 200 nm, it is achieved that durability or life is extended by about four times as compared with the life when thickness of $SiO_2$ film=100(nm).

When thickness of the $SiO_2$ film=100 nm, actual life is in the range of 500 to 1,000 hours. Accordingly, when estimated on the mentioned result, in the case of $SiO_2$ film thickness=200(nm), actual life is in the range of 2,000 to 4,000 hours.

When increasing the thickness of $SiO_2$ over 200 nm film formed by sol-gel method, a further improvement in reduction of migration can be expected.

As described above, as a result of changing the thickness of the $SiO_2$ film formed by sol-gel method from conventional 100 nm to not less than 200 nm, barrier function is improved due to thermal diffusion of metal Sn contained in the soda lime glass and silver component of the bus electrode 2.

Consequently, film quality of the transparent conductive film forming the transparent electrode 1 on the $SiO_2$ film is uniformed.

By synergism between the improvement in barrier function of the $SiO_2$ film and the uniformity in film quality of the transparent conductive film itself, the color change of the glass substrate to yellow is remarkably restrained.

Furthermore, as a result of forming the $SiO_2$ film by sol-gel method to have a thickness not less than 200 nm, even when dc voltage component occupies a large portion of time at the time of writing as is done in AC plane discharge type PDP, life is much improved as compared with the conventional thickness of $SiO_2$ film.

What is claimed is:

1. An AC plane discharge type plasma display panel comprising a first substrate section having a picture screen and a second substrate section arranged opposite to the first substrate section, and in which a desired picture is displayed by a gas discharge in plural discharge cells formed between said first substrate section and said second substrate section, characterized in that said first substrate section comprises:

a glass substrate containing sodium oxide serving as a base of said first substrate section;

an insulating film being a $SiO_2$ layer having not less than about 100 nm in thickness and formed by dry film formation method on the surface of said second substrate section of said glass substrate;

plural pairs of discharge sustain electrodes each comprising a transparent electrode and a bus electrode, formed on said insulating film, and arranged in parallel with a predetermined distance between one pair and another;

a dielectric layer formed on said insulating film in such a manner as to cover said plural pairs of discharge electrodes; and a cathode film formed on said dielectric layer.

2. An AC plane discharge type plasma display panel comprising a first substrate section having a picture screen and a second substrate section arranged opposite to the first substrate section, and in which a desired picture is displayed by a gas discharge in plural discharge cells formed between said first substrate section and said second substrate section, characterized in that said first substrate section comprises:

a glass substrate containing sodium oxide serving as a base of said first substrate section;

an insulating film being a $SiO_2$ layer having not less than about 200 nm in thickness and formed by wet film formation method on the surface of said second substrate section of said glass substrate;

plural pairs of discharge sustain electrodes each comprising a transparent electrode and a bus electrode, formed on said insulating film, and arranged in parallel with a predetermined distance between one pair and another;

a dielectric layer formed on said insulating film in such a manner as to cover said plural pairs of discharge electrodes; and a cathode film formed on said dielectric layer.

3. The AC plane discharge type plasma display panel according to claim 1, wherein said bus electrode is formed using silver of thick film.

4. The AC plane discharge type plasma display panel according to claim 2, wherein said bus electrode is formed using silver of thick film.

* * * * *